US005782425A

United States Patent [19]

Leskinen et al.

[11] Patent Number: 5,782,425

[45] Date of Patent: Jul. 21, 1998

[54] METHOD AND DEVICE FOR WINDING A PAPER WEB

[75] Inventors: Arto Leskinen, Nukari; Jari Sinkko, Järvenpää; Pauli Koutonen, Jokela, all of Finland

[73] Assignee: Valmet Corporation, Helsinki, Finland

[21] Appl. No.: 887,010

[22] Filed: Jul. 2, 1997

[30] Foreign Application Priority Data

Jul. 5, 1996 [FI] Finland ..... 962762

[51] Int. Cl.[6] ..... B65H 35/00

[52] U.S. Cl. ..... 242/526.3; 242/530

[58] Field of Search ..... 242/524.1, 526.3, 242/530, 530.1, 530.4

[56] References Cited

U.S. PATENT DOCUMENTS 4,875,632 10/1989 Kataoka .
5,152,471 10/1992 Goerner .

FOREIGN PATENT DOCUMENTS 0315568 5/1989 European Pat. Off. .
2514932 10/1976 Germany .
61-55047 3/1986 Japan ..... 242/530
63-267641 11/1988 Japan ..... 242/530

*Primary Examiner*—John P. Darling
*Attorney, Agent, or Firm*—Steinberg & Raskin, P.C.

[57] ABSTRACT

A method for winding a paper web in which the paper web is unwound from a paper reel and passed through a slitting station of a slitter-winder in which it is slit longitudinally into component webs by blades, and the component webs are further wound into component rolls. A portion of the ends of the slit component webs are cut off in a cutter device to provide them with predetermined measures, i.e., a predetermined initial length, before the component webs are passed into the winding stations. The winding device in winding of a paper web includes an unwind station and a slitter-winder which includes a slitting station, a cutter device, and the winding stations for component rolls. The cutter device of the slitter-winder includes an arrangement for cutting the component webs to provide the predetermined lengths therefor.

20 Claims, 5 Drawing Sheets

METHOD AND DEVICE FOR WINDING A PAPER WEB

FIELD OF THE INVENTION

The present invention relates to a method for winding a paper web in which the paper web is unwound from a paper reel, passed through a slitting station of a slitter-winder and slit in the slitting station of the slitter-winder longitudinally into component webs by means of blades, the component webs being further wound into component rolls.

The invention also relates to a winding device for winding a paper web or equivalent material or fibrous web comprising an unwind station and a slitter-winder which includes a slitting station, a cutter device, and winding stations for component rolls The invention also relates to an arrangement in winding of a paper web in which the paper web is brought having a full width to a slitter-winder and slit into narrower component webs in the slitter-winder, the component webs being further wound into component rolls. The invention is in particular related to a slitter-winder of the bottom draw center-drive winder type, in which a web of full width, i.e., having the width of the paper machine, is slit into narrower component webs in the longitudinal direction. The invention is, however, also suitable for use in connection with slitter-winders of other types.

The invention also relates to a method for threading a web onto winding drums of a winding device.

BACKGROUND OF THE INVENTION

In the prior art, constructions are known in which, in the tail threading in web slitters, devices are used which are based on various blowings and suctions. It has been noticed though that such blowing and/or suction devices are not sufficiently reliable for passing the leader end of the web to the slitter or for passing the component webs onto the winders for the component webs.

At present, in paper mills, of the various stages of processing, attempts are made to eliminate those stages that require an abundance of manual operations. One problematic stage is the tail threading stage, which often requires the work of several persons also at the finishing devices, winders, cutters, etc. Also, in paper machines, high running speeds are sought, in which case, in a paper finishing device, the web threading must take place as quickly and reliably as possible.

With respect to the prior art, reference is made to U.S. Pat. No. 5,152,471 which describes a reel slitter whose function is to slit a web of paper machine width in the longitudinal direction in a slitting or cutting station. In the arrangement known from this patent, a pull-in bar is used which can be passed through the machine by means of a chain and to which the initial end of the web can be attached. This prior art reel slitter comprises two support drums, on whose support the webs are wound. The pull-in device provided with a pull-in bar feeds the component webs onto a first one of the support drum. Further, a transfer device, which receives the non-adjacent component webs after their separation from the pull-in bars, feeds the webs by means of a suction tube onto a second one of the support drums. In this prior art construction, a suction tube has been employed as the grasping element for the component webs, which suction tube is a complicated device and has an unreliable adhesion. Further, the cutting off of the ends of the component webs and their possible attaching to the grasping element are difficult to make automatic, so that this construction is primarily suitable for manual operation only. The introduction of the component webs onto the winding drums requires running of the entire slitter-winder back and forth, which is slow and difficult.

Another drawback of this prior art construction is that in the final stage of the passing of the component webs onto the winding drums, the entire slitter-winder is run forwards, in which case the ultimate tightness of the web is determined in accordance with the grasping elements and thus remains lower than would be desirable in the beginning of winding.

In an arrangement in accordance with one embodiment in U.S. Pat. No. 5,152,471, problems may be caused by the transfer from the winding drum onto the drum because the threading bar can tear component webs to be transferred away from the suction in the drum, in which connection, moreover, the component webs are momentarily indefinitely free (slack) as the threading bar passes through the gap between the drums. Further, the removing of the remainders of web remaining on the threading bar after the cutting must be carried out manually after each threading operation.

OBJECTS AND SUMMARY OF THE INVENTION

It is an object of the present invention to provide a method and device for winding a paper web in which drawbacks of prior art constructions, such as U.S. Pat. No. 5,152,471 described above, do not occur.

Another object of the present invention is to provide a new and improved winding method and device which achieves threading of a web of full width into the winding device, which threading operates reliably and during which the work of one person only is required.

It is still another object of the present invention to provide an improved arrangement by whose means the leader end of the web can be threaded and the component webs be separated in connection with a slitter-winder of the bottom draw center-drive winder type.

In view of achieving the objects stated above and others, in the method in accordance with the invention, the ends of the slit component webs are cut off in a cutter device to provide the component webs with predetermined measures (lengths) before the component webs are passed into the winding stations. With respect to the predetermined lengths of the component webs, the initial end of each of the component webs may be cut off at a certain, predetermined location from the initial forward edge thereof so that, e.g., when subsequently transferred to a winding drum, the forward edge of the component webs extend to a desired predefined point on the winding drums which is optimum or preferred in the context of the initial winding of the web from the winding drums to roll spools. The portion of each component web which is cut off is determined by, e.g., the path traveled by the component web from the slitting station to the position about the winding drum which the roll spool will initially engage.

In the device in accordance with the invention, the cutter device of the slitter-winder includes an arrangement for cutting the component webs from a forward end thereof to provide the component webs with predetermined lengths.

In the present invention, the threading of the web and the splitting of the web into component webs in a slitter-winder of the bottom draw center-drive winder type are achieved quickly and reliably.

It is a particularly advantageous feature of the present invention that the web is unwound from the machine reel just once and moreover, transfer of the component webs onto the winding drums does not require running of the entire slitter-winder.

In connection with the arrangement in accordance with the present invention, it is possible to automatically drop the remainders of the web remaining on the threading bar after the cutting onto the basement floor, from where they can be passed, for example, once in a week into a pulper.

In the slitter-winder, the web is passed through the slitter device, in which the web will be slit into component webs during subsequent operation thereof, to the cutter device, in which the component webs are cut by means of one or more cutter blades to suitable lengths, i.e., a portion of the initial end adjacent the forward edge may be removed which thus alters the "length" of the entire component web. A nip is formed by means of the arrangement of a nip against a guide roll in the cutter device, which nip is closed before the cutting and through which nip the component webs run. The cutting of each of the component webs is carried out so that the ends of the component webs extend onto the winding drums to the desired, predetermined points, which are favorable in view of starting the rewinding, e.g., a point at which the roll spool will initially engage. The running of the web has been stopped for the time between the cutting of the component webs to the specified length(s) and the starting of the rewinding. After cutting, the component webs passing to the first winding station are separated from the component webs passing to the second winding station, in compliance with preset specifications and selections. The component webs passing to the first winding station are passed, by means of a threading member tightly tensioned between guides, onto the face of the winding drum in the first winding station, to which drum the web adheres, by the effect of the suction preferably present in the winding drum, and the threading member is returned to its intermediate position occupied during running. Similarly, the component webs passing onto the winding drum in the second winding station are raised by means of a second threading member onto the face of another winding drum preferably provided with suction, which drum face holds the web end. After this, the roll spools are lowered by means of sockets onto the component webs, e.g., into contact therewith, and the winding is started.

In accordance with the invention, the start of winding is thus quick, and a good roll bottom is achieved immediately because: 1) the ends of the component webs are in the correct positions in relation to the reel spools in the directions both of the axis and of the tangent of the winding drum; 2) owing to mechanized cutting, the ends of the component webs are whole and even; 3) the guide roll nip, which has been closed by pressing, keeps the major part of the web length tight, in which case, right at the beginning of the winding, the correct winding tension is obtained; and 4) the machine reel that is being unwound does not have to be rotated in order to align the ends of the component webs on the winding drums, in which connection the nip of the guide roll can maintain the tension.

For the reasons mentioned above, the component webs are invariably in correct positions in the cross direction of the machine, i.e., precisely in alignment with the spools. The spools are possibly provided with adhesive, double-sided adhesive tape, or with some other, equivalent arrangement in itself known to a person skilled in the art so as to fix the web end to the roll spool.

In the method for winding a paper web in accordance with the invention, the web is unwound from a paper reel and passed through a slitting station of a slitter-winder in which the web is slit longitudinally into component webs, e.g., by pressing at least one blade into engagement with the web. Each component web is wound in a winding station into a component roll. A portion of a forward end of each of the component webs is cut off before the component webs are passed into one of the winding stations such that each of the component web has a predetermined length. The component webs may be wound into component rolls in at least two separate winding stations such that at least one of the component webs is passed to each winding station. The component web(s) passing to each of the winding stations is/are separated from the component web(s) passing to other winding stations and the component webs passing to each winding station are transferred onto a winding drum of the respective winding station by means of a threading member. The components webs may be cut off such that a different predetermined portion is cut off from a forward end of the component web(s) passing to each of the winding stations, e.g., such that a forward edge of the component web(s) passing to each winding station reaches a pre-defined point on the respective winding drum when transferred by the respective threading member (which is usually different when using different winding drums and/or different configurations of equipment). Suction may be applied within the winding drums to cause the component webs to adhere to an outer face thereof.

The winding device for winding a web includes an unwind station in which a paper reel is unwound and a slitter-winder. The slitter-winder in accordance with the invention comprises a slitting station in which the paper reel is slit longitudinally into component webs, at least two winding stations for winding the component webs to form component rolls, and cutting means for cutting off a portion from a forward end of each component web before that component web is passed into one of the winding stations such that each component web has a predetermined length. In certain embodiments, the cutting means may be structured and arranged to cut off predetermined portions from a forward end of the component webs whereby a first predetermined portion is cut off from a first one of the component webs and a second predetermined portion different than the first predetermined portion is cut off from a second one of the component webs. The slitter-winder may also include means for separating the first component web from the second component web, and threading means for separately passing the first and second component webs into the respective winding stations. The threading means may comprise bars extending across the width of the component webs and rails arranged at both sides of the slitter-winder such that each bar is tensioned between the rails and is movable along the rails to transfer the component webs to one of the winding stations. The cutting means may comprise two spaced apart blades and a backup blade separated from the two blades by a gap through which the component webs pass, or a single displaceable cutter blade and a backup blade separated therefrom by a gap through which the component webs pass.

The method for threading a web onto winding drums of a winding device, comprises the steps of unwinding a paper reel to obtain a web of full width, slitting the web into component webs, winding the component webs into component rolls in at least two separate winding stations such that at least one of the component webs is passed to each of the winding stations, cutting off a first portion from a forward end of the component web(s) passing to a first one of the winding stations before the component web(s) is passed into the first winding station, cutting off a second portion different than the first portion from a forward end of the component web(s) passing to a second one of the winding stations before the component web(s) is passed into the second winding station, separating the component web (s) passing to the first winding station from the component web(s) passing to the second winding station, transferring the component web(s) passing to the first winding station onto a first winding drum of the first winding station, and transferring the component web(s) passing to the second winding station onto a second winding drum of the second winding station. As noted above, the forward end of the component webs may be cut such that a forward edge of the component web(s) passing to the first winding station reaches a pre-defined point on the first winding drum when transferred by the first threading member and a forward edge of the component web(s) passing to the second winding station reach a pre-defined point on the second winding drum when transferred by the second threading member.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
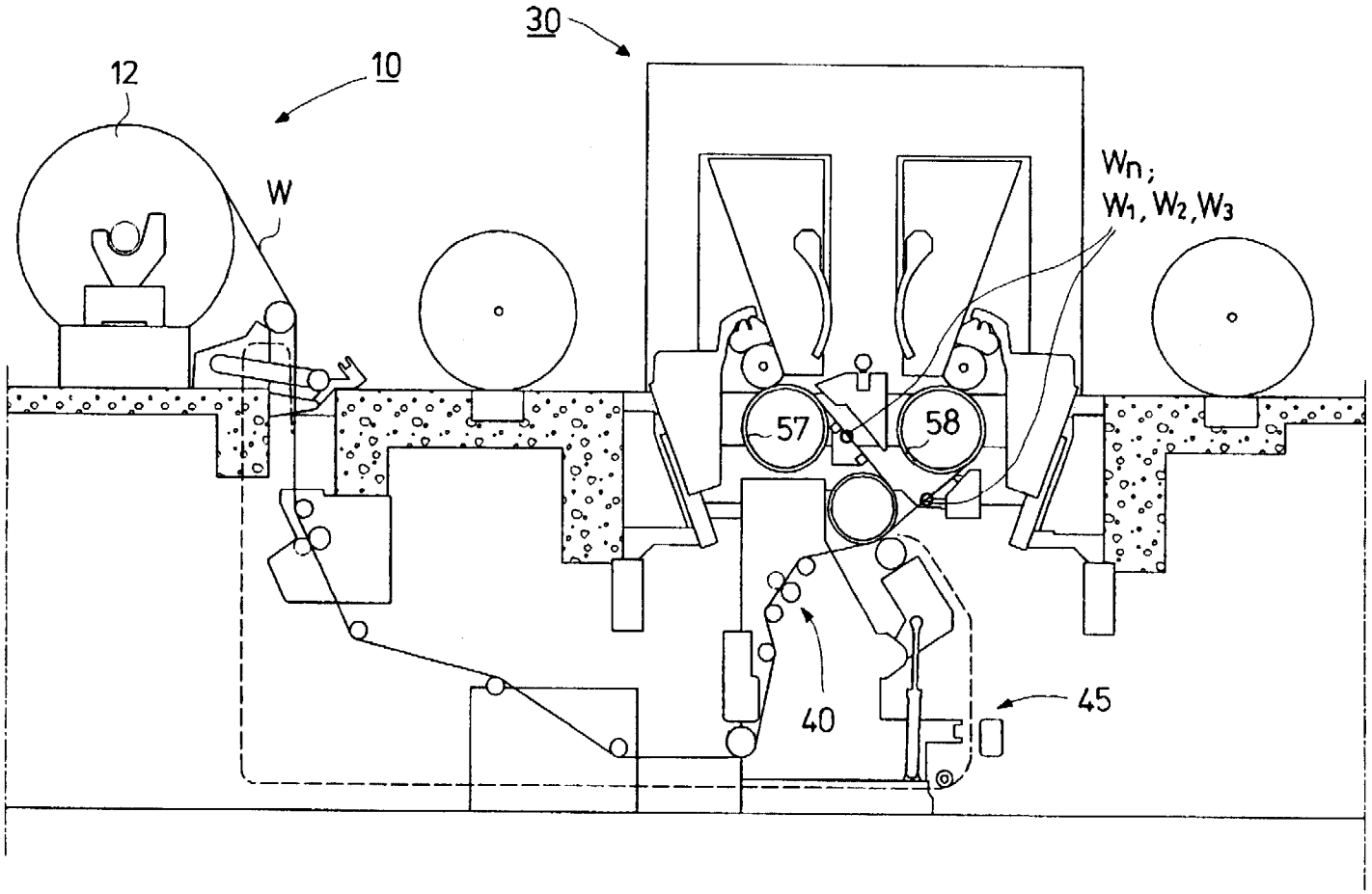
FIG. 1 is a schematic illustration of a slitter-winder of the bottom draw center-drive winder type in accordance with the invention.

Referring to FIGS. 1–5 wherein like reference numerals refer to the same or similar elements, as shown in FIG. 1, the winder device in accordance with the invention comprises an unwind station 10 in which a paper reel 12 is unwound to provide a paper web W of "full width". The web W is passed as a bottom draw into a winding device 30 in which it is divided into component webs $W_n$ which are wound into component rolls in a first winding station by means of a winding drum 57 and in a second winding station by means of a winding drum 58. The winding device 30 comprises a slitter part 40 in which the web W is slit longitudinally into the component webs $W_n$, $W_1$, $W_2$, $W_3$, etc. in accordance with predefined settings. Further, the winding device 30 comprises cutting means such as a cutter device 45, by whose means the web W is cut off in the cross direction, i.e., the width direction.

Figure 2:
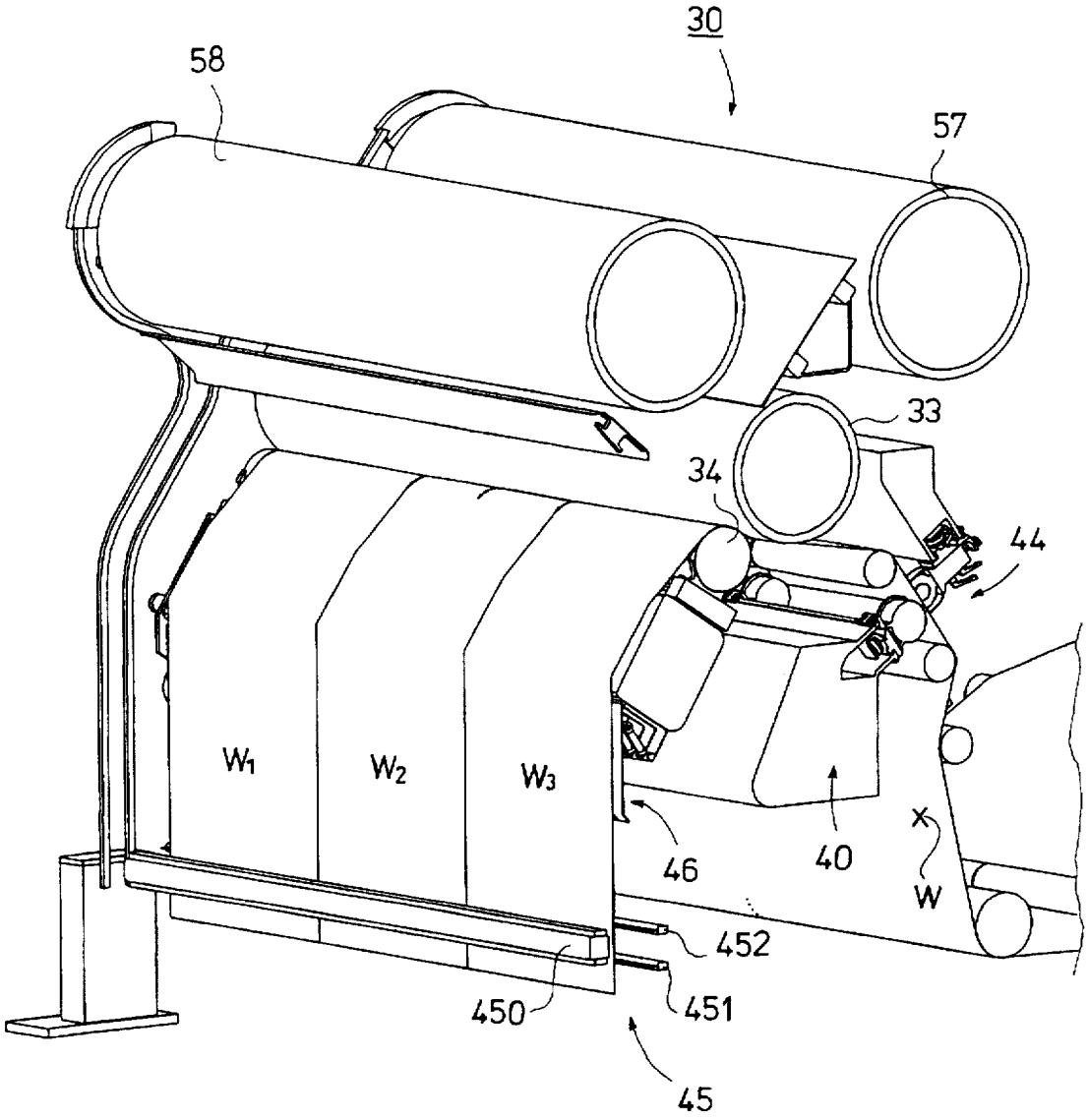
FIG. 2 is a schematic illustration of a slitter-winder in accordance with the invention, to which a web of full width has been passed, which web is slit into component webs.

As shown in FIG. 2, in the slitter part 40 of the winding device 30, a plurality of blades 44 (only one of which is shown) slit the web W, in accordance with predefined settings, into component webs $W_1$, $W_2$, $W_3$. After the slitter part 40, after the component webs $W_1$, $W_2$, $W_3$ have by-passed a guide roll 33, a nip roll 34 to be placed against the guide roll 33 is controlled to be positioned into a closed position in which connection the component webs $W_1$, $W_2$, $W_3$ run through the nip between the guide roll 33 and the nip roll 34 to the cutter device 45, in which a portion of the component webs $W_1$, $W_2$, $W_3$ is cut off at their forward end in the cross direction to provide the component webs with a certain initial length or predetermined measure such that the forward end of component webs $W_1$, $W_2$, $W_3$ will extend to the desired predefined points on the winding drums 57,58 when subsequently brought into engagement therewith. The nip between the guide roll and the nip roll 34 is thus closed prior to the cutting of the component webs $W_1$, $W_2$, $W_3$ by the cutter device 45.

The cutting of the forward end of the component webs $W_1$, $W_2$, $W_3$ is important because the component webs passing onto different winding drums must often be cut to different lengths unless the geometries of the guide roll 33 and of the winding drums 57 and 58 have been arranged so that the length of the web from the winding stations to the machine reel of the unwind stand is equal, in which case all the component webs can be cut to the same length. In other words, when using different winding stations, the initial length of the component webs, e.g., measured from the nip, being passed to each of the winding stations is often different. In the embodiment shown in FIG. 2, the cutting of the component webs at their forward end is carried out so that first all the component webs are cut to a longer measure or initial length of the component web (the smallest portion is first cut off) by means of the operation of a blade 451 moving against a backup blade 450 (this longer length being required for certain of the component webs being wound in one of the winding stations). After the longer component webs ($W_1$ and $W_3$ in FIG. 3) have been raised towards their own winding station, the component webs that remain shorter (only $W_2$ in FIG. 3) can be additionally cut by means of a blade 452 moving against the backup blade 450. A second preferred embodiment of cutting the component webs to different lengths or measures consists of a single cutter blade 451 or 452 that has been arranged to be displaceable so that it can effect some if not all of the desired cuttings.

Figure 3:
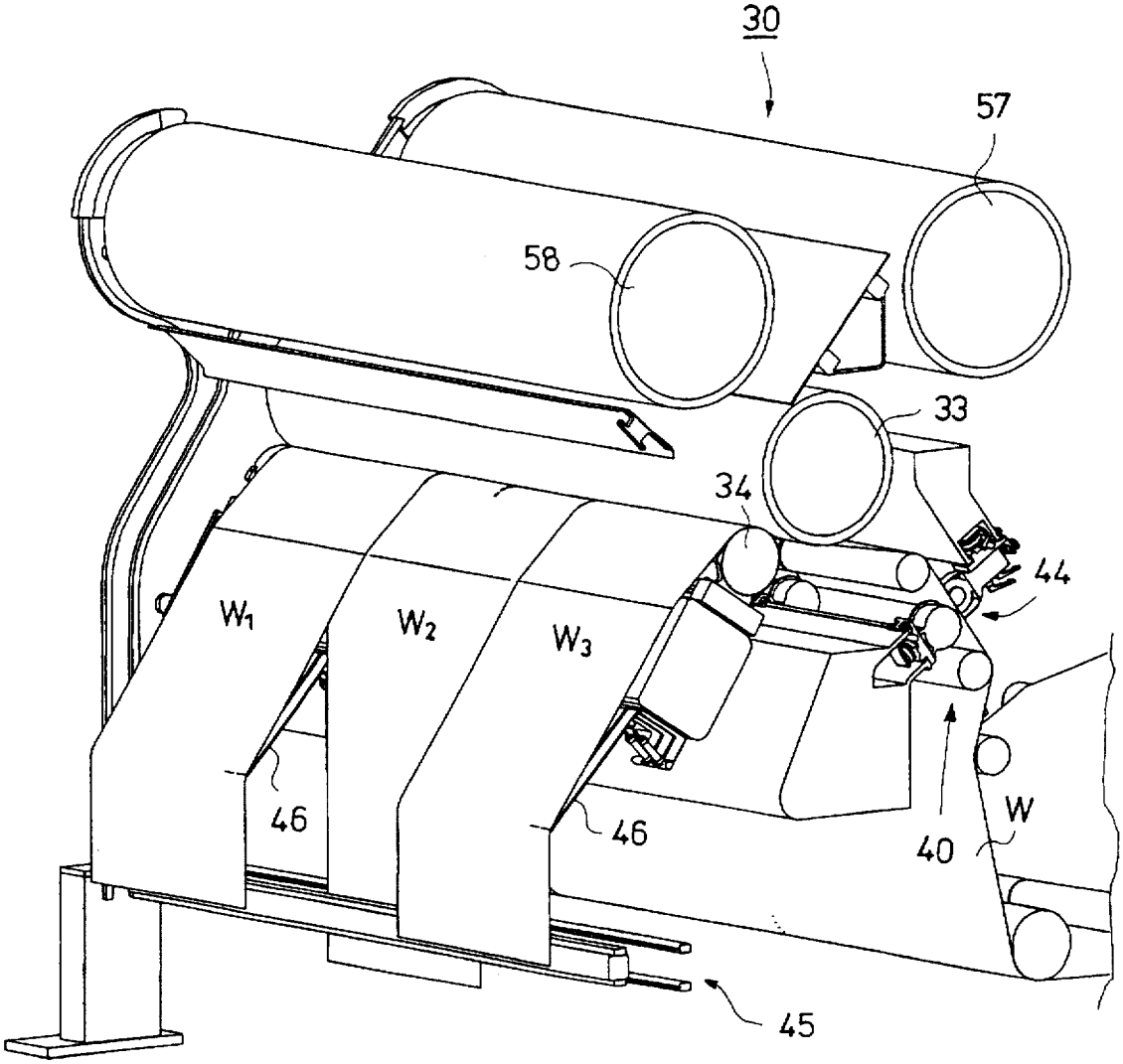
FIG. 3 is a schematic illustration of the slitter-winder in accordance with the invention in the stage in which the component webs are separated.

As shown in FIG. 3, after the cross-direction cutting-off is carried out by means of the cutter device 45, the component webs $W_1$, $W_2$, $W_3$ are separated in different directions by means of separators 46. In the situation shown in FIG. 3, the component webs $W_1$, $W_2$, $W_3$ passing to different winding stations are separated by means of the separators 46 in compliance with the setting applicable in each particular case. For each component web $W_1$, $W_2$, $W_3$, there is a set of separators 46 of its own, by means of which separators the component webs $W_1$, $W_2$ or $W_3$ are transferred into a position from which they are passed to the winding station. The component webs $W_1$, $W_3$ have been diverted from the plane of the component web $W_2$ by means of separators. The separators 46 are, for example, articulated bars provided with pneumatic cylinders.

In the situation shown in FIG. 4, the threading member 47 has been raised from below a gap between the separated component webs $W_1$, $W_3$ (raised by the separators 46) and the component web $W_2$ through the gap between the separated component webs $W_1$, $W_3$ and the component web $W_2$ that remained in its position, in which connection the threading member 47 raises the separated component webs $W_1$, $W_3$ along with it and carries them onto the winding drum 57. The component webs $W_1$, $W_3$ passing to the first winding station are carried by means of the threading member 47 onto the face of the winding drum 57, to which face the component web $W_1$, $W_3$ adheres, e.g., by the effect of the suction applied into the winding drum 57. In view of the cutting of the forward end of the component webs $W_1$, $W_3$ to provide the predetermined length thereof, the ends of the component webs $W_1$, $W_3$ are at a desired point optimum or preferred for subsequent winding onto the roll spools. A guide plate 48 prevents the component web from falling down from the threading member 47 and slackening of the component web on the portion between the guide roll 33 and the winding drum 57, which slackening would change the point to which the ends of the component webs $W_1$ and $W_3$ finally extend on the winding drum 57. Finally, the threading member 47 is returned to an intermediate position for the time of running operation.

Figure 5:
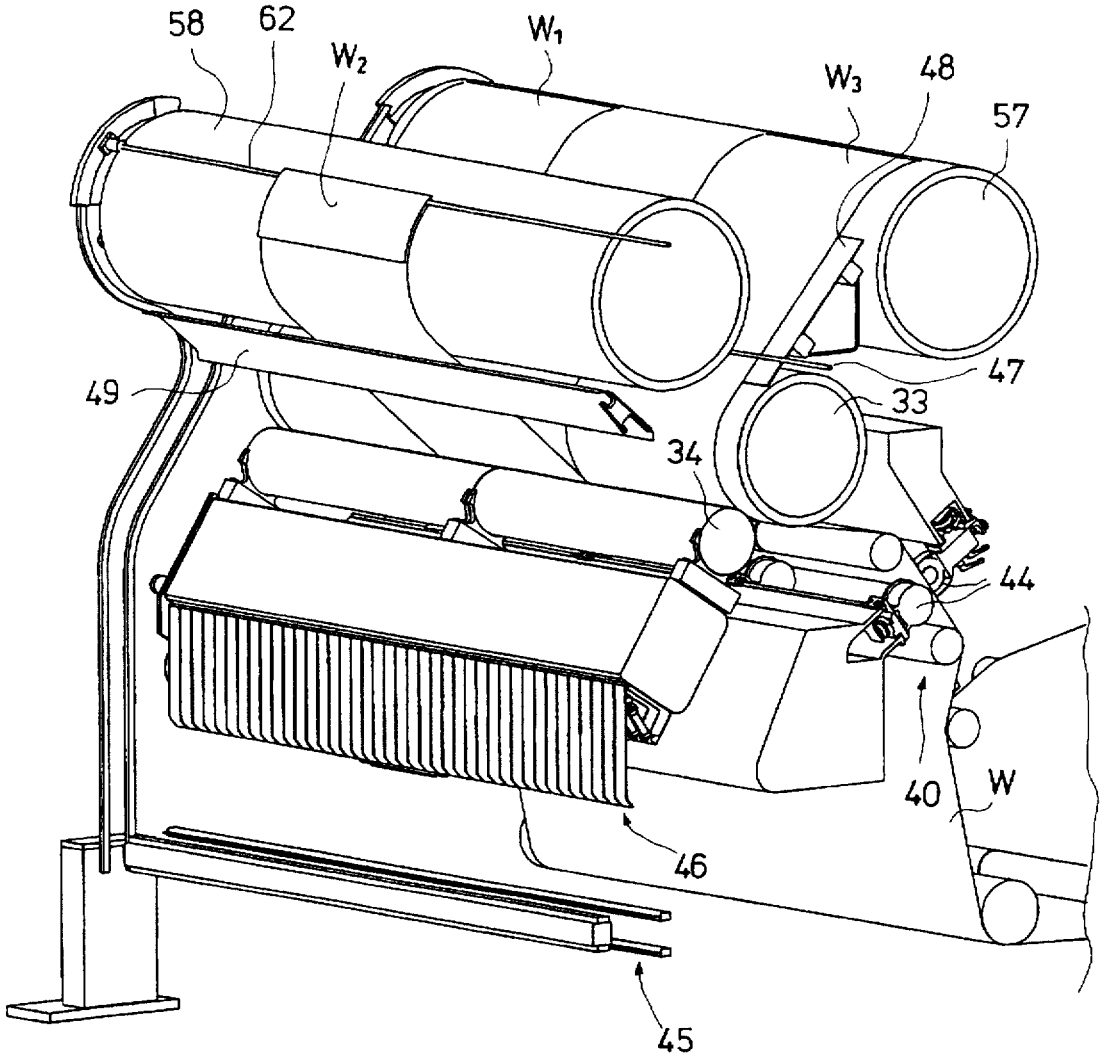
FIG. 5 is a schematic illustration of the slitter-winder in accordance with the invention in a situation in which a component web is raised into a second winding station.

In the situation shown in FIG. 5, the component web $W_2$ passing to the second winding station are passed by means of a threading member 62 onto the winding drum 58. A guide plate 49 permits holding of the component web on its straight track, similarly to the guide plate 48. This drum 58 is preferably also provided with suction to facilitate adherence of the component web $W_2$ to the winding drum 58.

By means of the guide plates 48 and 49, and in particular by means of the guide plate 49, it is possible to regulate the tension of the component webs during their raising onto the winding drums by varying the position of the guide plate in relation to the threading member. The higher the contact pressure is between the end of the component web and the guide plate, the higher the friction force with which the plate counteracts the gliding of the web and the higher the tension that is formed in the component web when the threading member 47,62 raises the component web.

Figure 4:
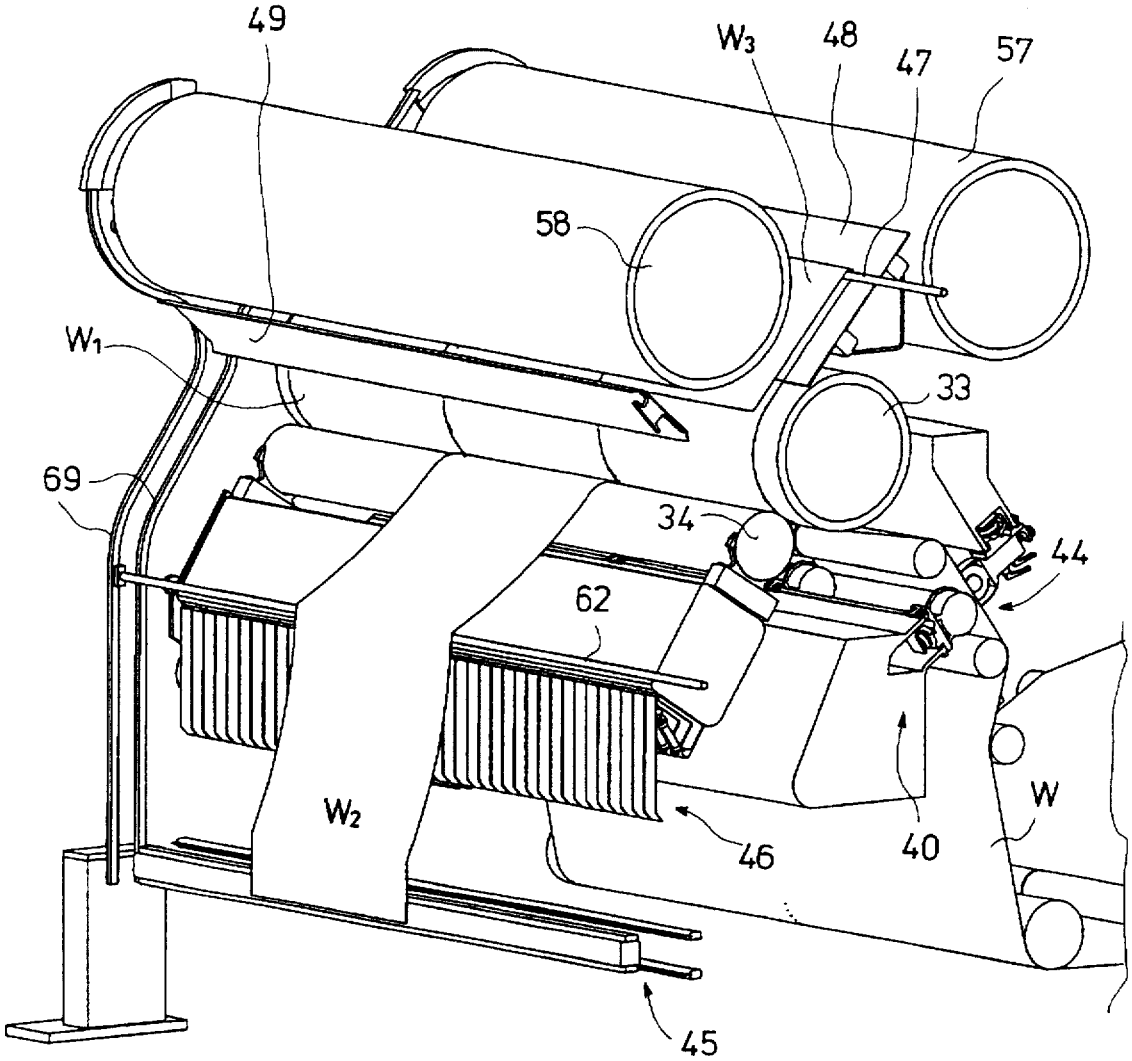
FIG. 4 is a schematic illustration of the slitter-winder in accordance with the invention in a situation in which a component web is raised into a first winding station.

As shown in FIGS. 4 and 5, the threading members 47 and 62 are bar-like members which extend across the width of the winding device in the cross direction of the component webs W', and these members move along rails 69 provided at both sides of the winding device 30 as tightly tensioned between these rails. The threading member 47,62 is, for example, a wire cable or equivalent, guided and tightened from its ends. After the threading operation described above, the spools are lowered by means of the sockets onto the component webs, and the winding by means of the slitter-winder is started. The spools can be provided, for example, with adhesive, double-sided adhesive tape, or with any other arrangements in themselves known to a person skilled in the art, by whose means the web is attached to the spools.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. In a method for winding a paper web in which the paper web is unwound from a paper reel and passed through a slitting station of a slitter-winder, the paper web being slit in the slitting station of the slitter-winder longitudinally into component webs, each of the component webs being wound in a winding station into a component roll, the improvement comprising the step of:

cutting off a portion of each of the component webs from a forward end thereof before the component webs are passed into one of the winding stations such that each of the component webs has a predetermined length.

2. The method of claim 1, further comprising the step of:

pressing at least one blade into engagement with the web in the slitter-winder to slit the web into the component webs.

3. The method of claim 1, further comprising the steps of winding the component webs into component rolls in at least two separate winding stations such that at least one of the component webs is passed to each of the winding stations, separating the at least one component web passing to a first one of the at least two winding stations from the at least one component web passing to a second one of the at least two winding stations, transferring the at least one component web passing to the first winding, station onto a first winding drum of the first winding station by means of a first threading member, and transferring the at least one component web passing to the second winding station onto a second winding drum of the second winding station by means of a second threading member.

4. The method of claim 3, wherein said cutting off step comprises the step of cutting a first predetermined portion from a forward end of the at least one component web passing to the first winding station and cutting a second predetermined portion different than the first predetermined portion from a forward end of the at least one component web passing to the second winding station.

5. The method of claim 4, wherein the component webs are cut such that a forward edge of the at least one component web passing to the first winding station reaches a pre-defined point on said first winding drum when transferred by said first threading member and a forward edge of the at least one component web passing to the second winding station reaches a pre-defined point on said second winding drum when transferred by said second threading member.

6. The method of claim 3, further comprising the step of:

applying suction within said first and second winding drums to cause the component webs to adhere to an outer face of said first and second winding drums.

7. The method of claim 3, further comprising the steps of:

directing the at least one component web passing to the first winding station over a first guide plate, directing the at least one component web passing to the second winding station over a second guide plate, and regulating the tension of the component webs by varying the position of said first guide plate in relation to said first threading member and the position of said second guide plate in relation to the said second threading member.

8. The method of claim 1, further comprising the steps of:

passing the web over a first roll after the slitting station, and then controlling the position of the first roll relative to a second roll arranged in opposed relationship to said first roll to define a nip between said first and second rolls such that the component webs pass through said nip.

9. The method of claim 1, further comprising the step of:

winding the component webs into component rolls in at least two separate winding stations such that at least one of the component webs is passed to each of the winding stations, said cutting off step comprising the steps of cutting a first predetermined portion from a forward end of the component webs passing to a first one of the winding stations and cutting a second predetermined portion different than the first predetermined portion from a forward end of the component webs passing to a second one of the winding stations.

10. The method of claim 1, further comprising the step of:

determining the portion of each of the component webs cut off from the forward end thereof and thus the predetermined length of each of the component webs based on the length of a path traveled by the component web from the slitting station to a position about the respective winding drum at which a roll spool onto which the component web is wound to form the component roll will initially engage.

11. In a winding device for winding a web including an unwind station in which a paper reel is unwound and a slitter-winder, the slitter-winder including a slitting station in which the paper reel is slit longitudinally into component webs and at least two winding stations for winding the component webs to form component rolls, the improvement comprising cutting means for cutting off a portion of each of the component webs from a forward end thereof before the component webs are passed into one of the winding stations such that each of the component webs has a predetermined length.

12. The device of claim 11, wherein said cutting means are structured and arranged to cut different portions from the component webs such that a first one of the component webs has a first predetermined length and a second one of the component webs has a second predetermined length different than the first predetermined length, said slitter-winder further comprising means for separating the first component web from the second component web, and threading means for separately passing the first and second component webs into the respective winding stations.

13. The device of claim 12, wherein each of said winding stations includes a winding drum, said first and second predetermined length being selected such that a forward edge of said first and second component web reaches a predefined point on the respective one of said winding drums of said first and second winding stations.

14. The device of claim 13, wherein said winding drums comprise suction winding drums for applying suction to an outer face such that the component webs adhere thereto.

15. The device of claim 12, wherein said threading means comprise bars extending across the width of the component webs and rails arranged at both sides of the slitter-winder such that each of said bars is tensioned between said rails, said bars being movable along said rails to transfer the component webs to one of the winding stations.

16. The device of claim 11, further comprising a guide roll and a nip roll arranged to be positioned against one another to form a nip after the slitting station and through which the component webs pass.

17. The device of claim 11, wherein said cutting means comprises two spaced apart blades and a backup blade separated from said two blades by a gap through which the component webs pass.

18. The device of claim 11, wherein said cutting means comprises a single displaceable cutter blade and a backup blade separated from said cutter blade by a gap through which the component webs pass.

19. A method for threading a web onto winding drums of a winding device, comprising the steps of:

unwinding a paper reel to obtain a web of full width, slitting the web into component webs, winding the component webs into component rolls in at least two separate winding stations such that at least one of the component webs is passed to each of the winding stations, cutting off a first portion from a forward end of the at least one component web passing to a first one of the winding stations before the at least one component web is passed into the first winding station, cutting off a second portion different than the first portion from a forward end of the at least one component web passing to a second one of the winding stations before the at least one component web is passed into the second winding station, separating the at least one component web passing to the first winding station from the at least one component web passing to the second winding station, transferring the at least one component web passing to the first winding station onto a first winding drum of the first winding station, and transferring the at least one component web passing to the second winding station onto a second winding drum of the second winding station.

20. The method of claim 19, wherein the forward end of the component webs is cut such that a forward edge of the at least one component web passing to the first winding station reach a pre-defined point on said first winding drum when transferred by a first threading member and a forward edge of the at least one component web passing to the second winding station reach a pre-defined point on said second winding drum when transferred by a second threading member, further comprising the step of:

applying suction within said first and second winding drums to cause the component webs to adhere to an outer face of said first and second winding drums.

* * * * *